US009528267B1

(12) United States Patent
Penrod et al.

(10) Patent No.: US 9,528,267 B1
(45) Date of Patent: Dec. 27, 2016

(54) CAP FLASHING DEVICE

(71) Applicants: Gary Penrod, Yucaipa, CA (US); Nancy Penrod, Yucaipa, CA (US)

(72) Inventors: Gary Penrod, Yucaipa, CA (US); Nancy Penrod, Yucaipa, CA (US)

( * ) Notice: Subject to any disclaimer, the term of this patent is extended or adjusted under 35 U.S.C. 154(b) by 0 days.

(21) Appl. No.: 14/087,001

(22) Filed: Nov. 22, 2013

Related U.S. Application Data

(63) Continuation-in-part of application No. 13/527,969, filed on Jun. 20, 2012, now abandoned.

(60) Provisional application No. 61/571,183, filed on Jun. 22, 2011.

(51) Int. Cl.
*E04D 3/40* (2006.01)
*E04D 3/38* (2006.01)

(52) U.S. Cl.
CPC .. *E04D 3/40* (2013.01); *E04D 3/38* (2013.01)

(58) Field of Classification Search
CPC ..... E04D 13/02; E04D 13/14; E04D 13/1415; E04D 13/147; E04D 13/1471; E04D 13/1473; E04D 13/1478; E04D 13/1475; E04D 13/15; E04D 13/1585; E04D 13/155; E04D 1/3405; E04D 2001/301; E04D 2001/303; E04D 2001/304; E06B 1/62; E06B 2001/628; E06B 7/02; E06B 7/18; E06B 1/66; E06B 1/665; E06B 1/70
USPC ..... 52/58, 60, 97, 302.6, 11, 13, 198, 287.1
See application file for complete search history.

(56) References Cited

U.S. PATENT DOCUMENTS

| | | | | |
|---|---|---|---|---|
| 618,074 | A * | 1/1899 | Dyer | 52/58 |
| D221,941 | S * | 9/1971 | Murphy | D25/199 |
| 2005/0055914 | A1* | 3/2005 | Gilstrap | 52/272 |
| 2005/0268561 | A1* | 12/2005 | Lane | 52/58 |

* cited by examiner

*Primary Examiner* — Jessica Laux
(74) *Attorney, Agent, or Firm* — Kenneth P. Avila

(57) ABSTRACT

A cap flashing device for overlapping and joining two upper-end pieces of valley flashing within two valleys on a main roof is provided. An adjoining roof forms the two valleys where it meets the main roof. The device comprises a sheet of material having top and bottom surfaces and a raised triangular portion in the material and extending above the material. The triangular portion has a pair of sides in an angled relation to the remaining portion of the material with the remaining portion remaining substantially planar. Upon positioning the material upon the roof, the triangular portion is positioned over the adjoining roof and the remaining portion of the material overlapping and joining the upper end pieces of the flashing thereby inhibiting leakage in either of the valleys with the entire material in complete direct contact with the main roof with the sides being free from any folds or tucks.

5 Claims, 6 Drawing Sheets

CAP FLASHING DEVICE

The present application is a continuation-in-part of pending patent application Ser. No. 13/527,969, filed on Jun. 20, 2012, entitled "Cap Flashing Device" which claims the benefit of priority of provisional patent application Ser. No. 61/571,183, filed on Jun. 22, 2011, entitled "Cap Flashing".

BACKGROUND OF THE INVENTION

1. Field of the Invention

This invention relates generally to a cap flashing device and, more particularly, the invention relates to a cap flashing device presenting roofers with a new, specially designed piece of flashing, designed to overlap and join two upper-end pieces of valley flashing, and thereby inhibiting any leakage occurring in either of the two valleys created where two sub-roofs meet.

2. Description of the Prior Art

Roof flashing is usually aluminum or galvanized steel that is used over joints in roof and wall construction to prevent water seeping in and causing damage. Depending on the style of roof, flashing is placed in the valleys, around the chimney and pipes, and around any dormer windows or skylights. Whether the roof is asphalt shingle, cedar shake, or Mission tile, the flashing, where necessary, is used beneath this material. Valleys are the junctions in a roof where the slopes of two sub-roofs meet. As the word valley implies, these junctions collect and drain rainwater, and although they are flashed, they are also notorious for leakage. It would be desirable to offer roofing contractors a specially designed piece of flashing to effectively address the leakage problems long associated with roof valleys.

SUMMARY

The present invention is a cap flashing device for overlapping and joining two upper-end pieces of valley flashing within two valleys on a main roof. An adjoining roof forms the two valleys where the adjoining roof meets the main roof. A cap flashing device for overlapping and joining two upper-end pieces of valley flashing within two valleys on a main roof, an adjoining roof forming the two valleys where the adjoining roof meets the main roof. The cap flashing device comprises a sheet of material having a top surface and a bottom surface and a raised triangular portion formed in a portion of the sheet of material and extending above the top surface. The raised triangular portion has a pair of sides in an angled relation to the remaining portion of the sheet of material with the remaining portion of the sheet of material remaining substantially planar. Upon positioning the bottom surface of the sheet of material upon the roof, the triangular portion is positioned over the adjoining roof and the remaining portion of the sheet of material overlapping and joining the two upper end pieces of the valley flashing thereby inhibiting leakage in either of the two valleys of the roof with the entire bottom surface of the sheet of material in complete direct contact with the main roof, the pair of sides being free from any folds or tucks.

In addition, the present invention includes a cap flashing device for overlapping and joining two upper-end pieces of valley flashing within two valleys on a main roof. The adjoining roof forms the two valleys where the adjoining roof meets the main roof. The cap flashing device comprises a single, rectangular sheet of material having a top surface and a bottom surface and a raised triangular portion formed in a portion of the sheet of material and extending above the top surface. The raised triangular portion having a pair of sides in an angled, non-perpendicular relation to the remaining portion of the sheet of material with the remaining portion of the sheet of material remaining substantially planar. Upon positioning the bottom surface of the sheet of material upon the roof, the triangular portion is positioned over the adjoining roof and the remaining portion of the sheet of material overlapping and joining the two upper end pieces of the valley flashing thereby inhibiting leakage in either of the two valleys of the roof with the entire bottom surface of the sheet of material in complete direct contact with the main roof, the pair of sides being free from any folds or tucks.

The present invention further includes a cap flashing device for overlapping and joining two upper-end pieces of valley flashing within two valleys on a main roof. An adjoining roof forms the two valleys where the adjoining roof meets the main roof. The cap flashing device comprises a sheet of material having a top surface, a bottom surface, a first edge, a second edge opposite the first edge and substantially parallel to the first edge, a third edge between the first edge and the second edge, and a fourth edge opposite the third edge and between the first edge and the second edge. A raised triangular portion is formed in the first edge of the sheet of material and extending above the top surface with the raised triangular portion having a pair of sides in an angled relation to the remaining portion of the sheet of material, the remaining portion of the sheet of material remaining substantially planar and the triangular portion defining a first vertex point, a second vertex point, a third vertex point, and a fourth vertex point. A V-notch is formed in the first vertex point and/or the second vertex point for receiving at least a portion of the valley flashing ridge. Upon positioning the bottom surface of the sheet of material upon the roof, the triangular portion is positioned over the adjoining roof and the remaining portion of the sheet of material overlapping and joining the two upper end pieces of the valley flashing thereby inhibiting leakage in either of the two valleys of the roof with the entire bottom surface of the sheet of material in complete direct contact with the main roof, the pair of sides being free from any folds or tucks.

DETAILED DESCRIPTION OF THE PREFERRED EMBODIMENTS

Figure 1:
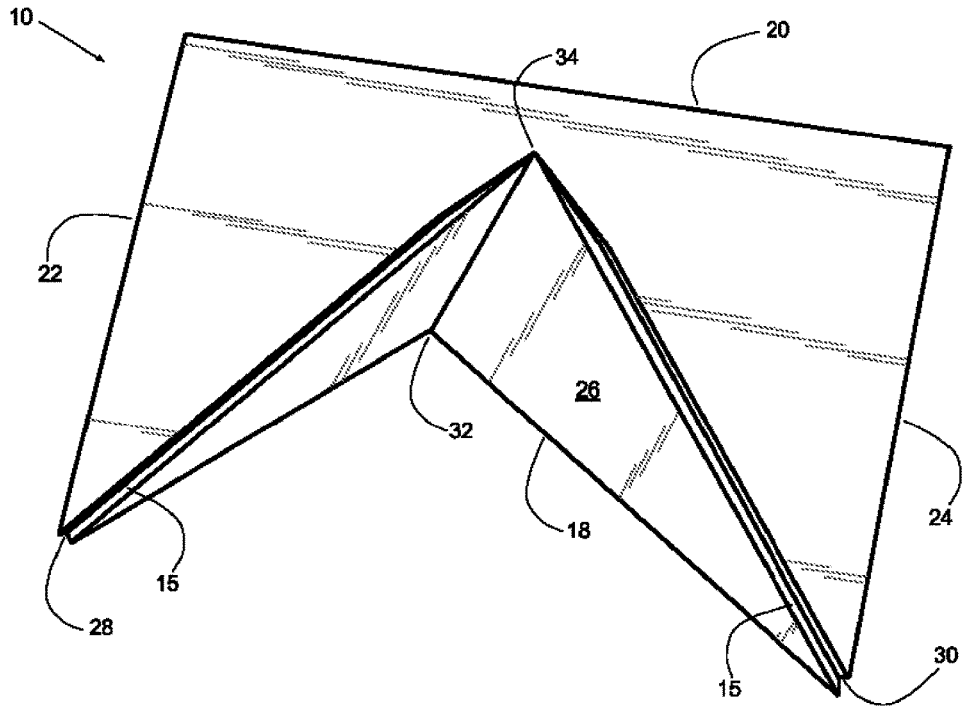
FIG. 1 is a perspective view illustrating a cap flashing device, constructed in accordance with the present invention.
Figure 2:
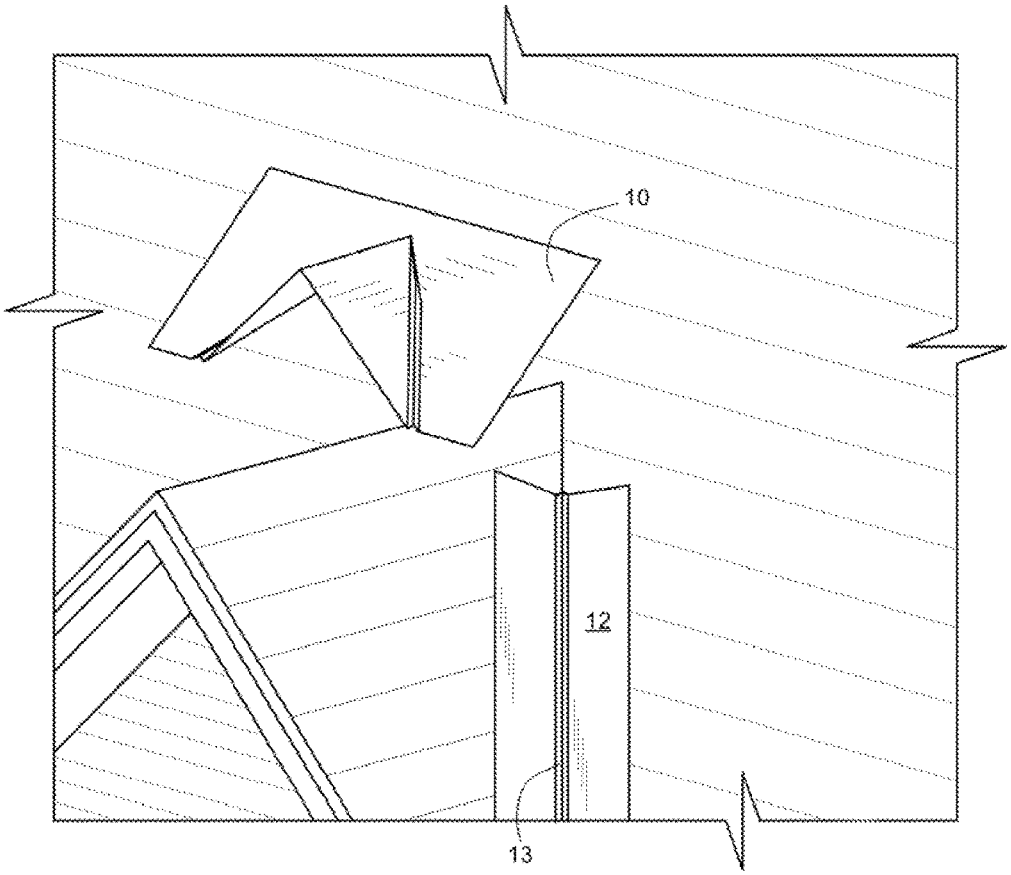
FIG. 2 is a perspective view illustrating the cap flashing device, constructed in accordance with the present invention, prior to mounting of the cap flashing device on a roof.
Figure 3:
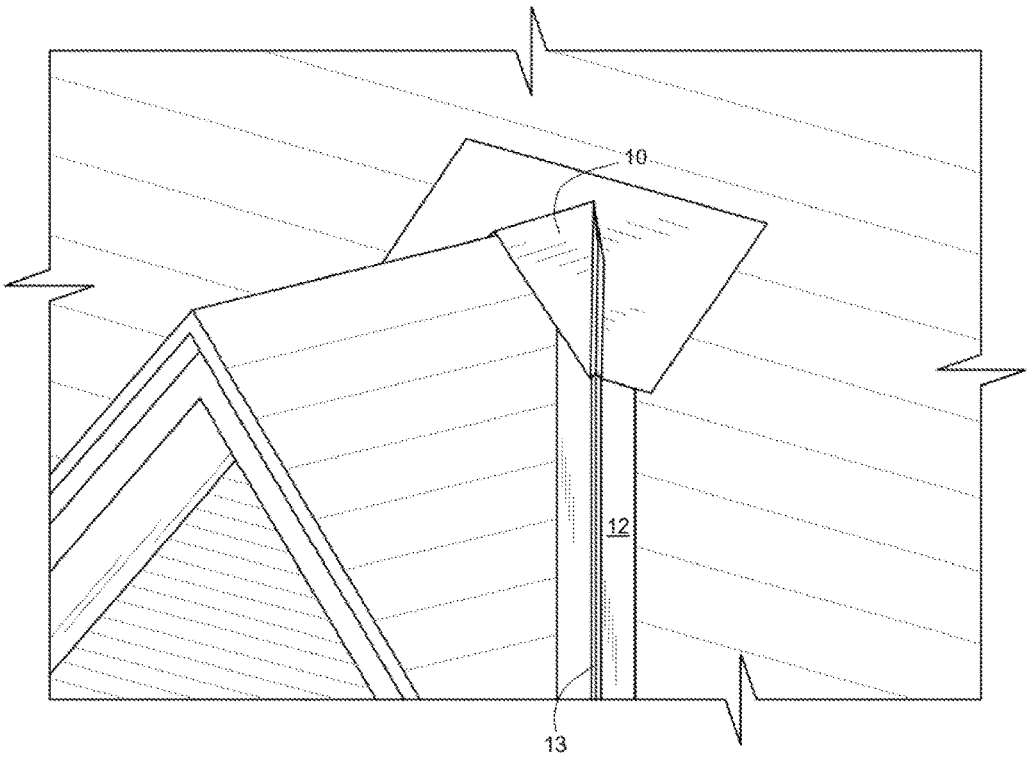
FIG. 3 is a perspective view illustrating the cap flashing device, constructed in accordance with the present invention, subsequent to mounting of the cap flashing device on the roof.
Figure 4:
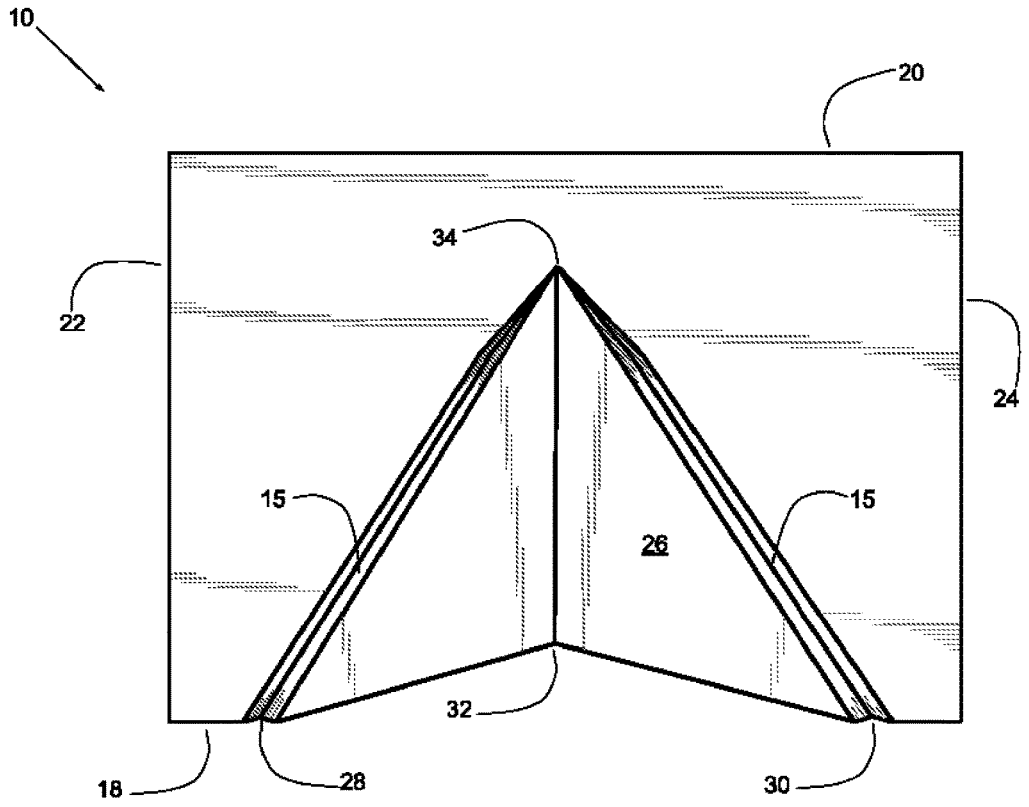
FIG. 4 is a top plan view illustrating the cap flashing device, constructed in accordance with the present invention.
Figure 5:
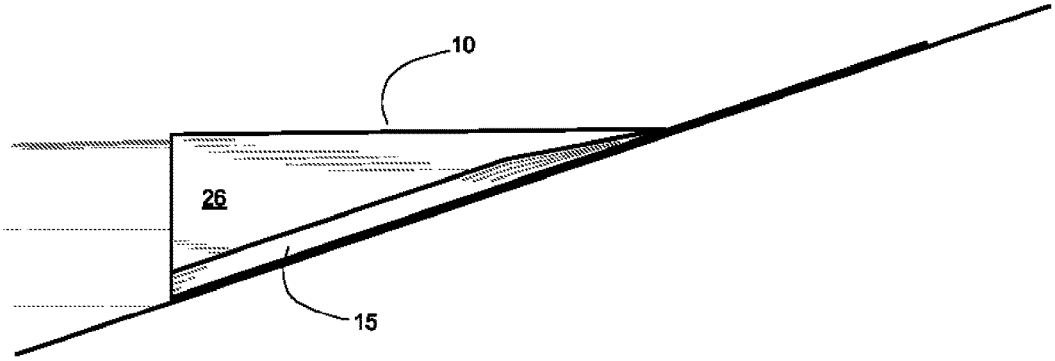
FIG. 5 is an elevational side view illustrating the cap flashing device, constructed in accordance with the present invention.
Figure 6:
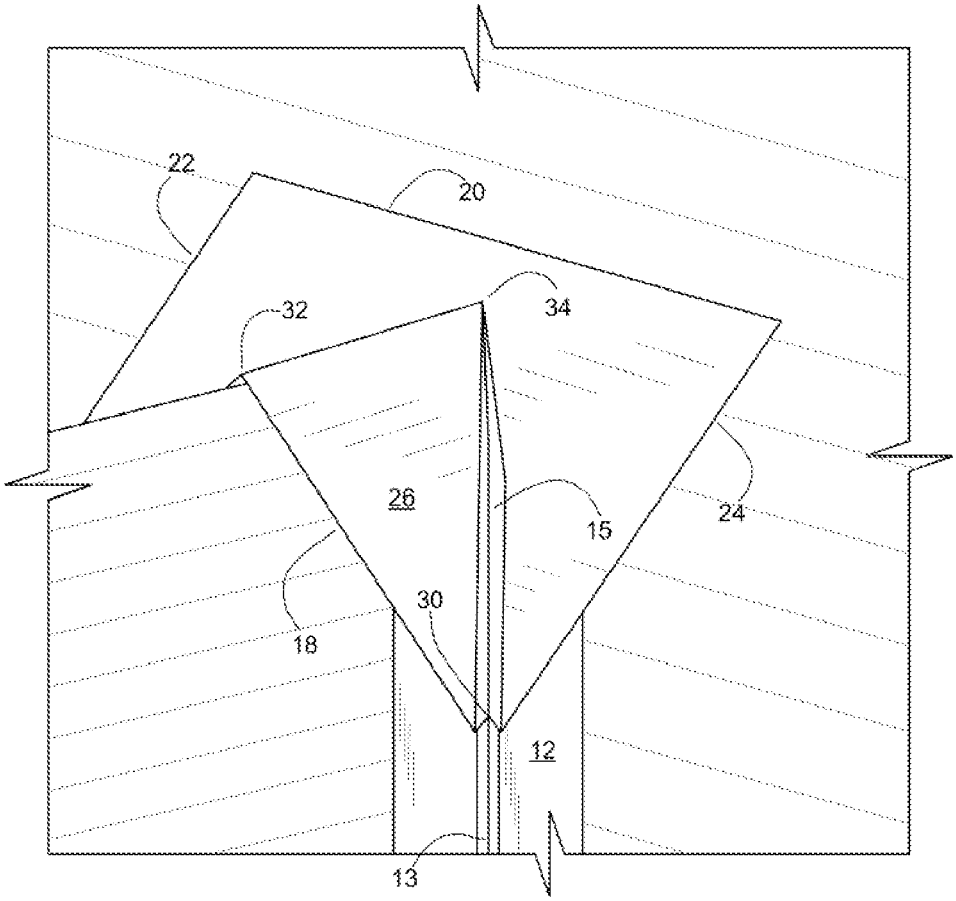
FIG. 6 is a perspective view illustrating a V-notch formed in the cap flashing device, constructed in accordance with the present invention, for receiving the valley flashing ridge.

As illustrated in FIGS. 1-6, the present invention is a cap flashing device, indicated generally at 10, presenting roofers with a new, specially designed piece of flashing, designed to overlap and join two upper-end pieces of valley flashing 12, and thereby inhibiting any leakage occurring in either of the two valleys created where two sub-roofs meet. Typically, the valley flashing 12 has a raised valley flashing ridge 13.

In a preferred embodiment, the cap flashing device 10 of the present invention consists of one rectangular piece 14 of aluminum sheet metal (specified as #5052, in a 24- or similar gauge). In addition, the cap flashing device 10 is preferably constructed in two versions with one measuring approximately twenty-four (24") inches by approximately thirty (30") inches and the second measuring approximately thirty (30") inches by approximately thirty-six (36") inches, and intended to join the valley flashings of roofs with a 4/12 to 4/12, a 5/12 to 5/12, or a 6/12 to 6/12 pitch (pitch being rise/run). It should be noted that while particular materials and dimensions are set forth herein, it is within the scope of the present invention to construct the cap flashing device 10 from other types of materials in other dimensions.

The material sheet 14 of the cap flashing device 10 of the present invention has a top surface 16, a bottom surface substantially opposite the top surface, a first edge 18, a second edge 20 opposite the first edge 18 and substantially parallel to the first edge 18, a third edge 22 between the first edge 18 and the second edge 20, and a fourth edge 24 opposite the third edge 22 and between the first edge 18 and the second edge 20. Preferably, the first edge 18 is substantially parallel to the second edge 20, the third edge 22 is substantially parallel to the fourth edge 24, and the first edge 18 and the second edge 20 are substantially perpendicular to the third edge 22 and the fourth edge 24.

In addition, the cap flashing device 10 of the present invention includes a raised triangular portion 26 formed in the first edge 18 of the material sheet 14 with a first vertex point 28, a second vertex point 30, a third vertex point 32, and a fourth vertex point 34. The first vertex point 28 of the triangular portion 26 can be positioned at the third edge 22 of the material sheet 14 or can be positioned along the first edge 18 short of the third edge 22 of the material sheet 14. The second vertex point 30 of the triangular portion 26 can be positioned at the fourth edge 24 of the material sheet 14 or can be positioned along the first edge 18 short of the fourth edge 24 of the material sheet 14. Furthermore, the fourth vertex point 34 of the triangular portion 26 can be positioned at the second edge 20 of the material sheet 14 or can be positioned short of the second edge 20 of the material sheet 14.

The cap flashing device 10 of the present invention is positioned over two standard valley flashings 12 where they meet at the top (of the valleys), thereby simplifying the termination of both valleys, reducing both the labor time and the possibility of leaks. The cap flashing device 10 features the raised triangular portion 26 fitting over the "V" of the joining roof, and allowing the remainder of the material sheet 14 to lay flat well in excess of the actual valley areas, thus effectively laying down a "collar" over the valley(s) and the roof junction. The cap flashing device 10 can include a V-notch 15 for receiving the valley flashing ridge 13. The V-notch allows the cap flashing device 10 to "interlock" with the valley flashing 12 and the valley flashing ridge 13 thereby providing a better fit. The cap flashing device 10, once firmly in place, is preferably sealed with roofing cement and/or caulking compound.

The cap flashing device 10 of the present invention has a raised triangular portion with a pair of sides in an angled, non-perpendicular relation to the remaining portion of the sheet of material with the entire bottom surface of the sheet of material in complete direct contact with the main roof and the pair of sides being free from any folds or tucks. Complete and direct contact with the main roof together with the cap flashing device 10 being constructed from one piece of pressed aluminum eliminates overlaps and joints. By having the sides angled, the cap flashing device 10 is made to fit securely over standard metal valley flashing including the center ridge of the valley flashing. The cap flashing device 10 saves save time, money, and eliminates the possibility of leak. The cap flashing device 10 can be constructed to accommodate roofs having a variety of pitches and used primarily with standard metal valley flashing with any type of roofing material.

The two great advantages of the cap flashing device 10 of the present invention is its effectiveness in stopping leaks in roof valleys and its ease of installation. For the contractor, ease of installation means a saving in labor costs; and leak-prevention means not only a better reputation and more referrals, but also a savings in expenses related to return trips to find and stop leaks. For the homeowner, the ease of installation associated with the cap flashing device 10 means a slightly lower price from the contractor. But whether or not the roofing job is less expensive, the main benefit is knowing that the roofing job is good and the flashings doing their job in preventing leakage are a big part.

Furthermore, the cap flashing device 10 of the present invention is a one piece pressed aluminum flashing made specifically to be used with standard 16" metal valley flashing on new roofs. Once the valley flashing is in place, prior to applying the roofing material, the cap flashing device 10 is set in place where the two valley flashings meet. The roofing material can then be applied with no risk of leaks. The cap flashing device 10 covers approximately 12" of the ridge of the attaching roof and 12" up the roof where they meet. All standard valley flashing has a raised ridge (approximately ¾") that runs down the middle of the valley to divert water down the flashing. The cap flashing device 10 is used where the ridge of one roof meets another roof below its ridge and is the only flashing designed to fit exactly over the raised ridge to prevent water from getting under the valley flashing from things like heavy winds, ice dams, etc.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A cap flashing device for overlapping and joining two upper-end pieces of valley flashing within two valleys on a main roof, an adjoining roof forming the two valleys where the adjoining roof meets the main roof, a valley flashing ridge formed in the valley flashing, the cap flashing device comprising:

a sheet of material having a top surface and a bottom surface, a first edge, a second edge opposite the first edge, a third edge between the first edge and the second edge, and a fourth edge opposite the third edge; and a raised triangular portion formed in a portion of the sheet of material and extending above the top surface, the raised triangular portion having a pair of sides in an angled relation to the remaining portion of the sheet of material, the raised triangular portion defining a first vertex point positioned at the first edge, a second vertex point positioned at the first edge, a third vertex point being the apex of the raised triangular portion positioned at the first edge and in between the first vertex point and the second vertex point, and a fourth vertex point positioned at some point short of the second edge;

a planar portion being substantially the portion of the sheet of material remaining beyond the raised triangular portion;

a first V-notch formed continuously from the first vertex point to the fourth vertex point being substantially triangular in shape with a first raised side abutting the planar portion, a second raised side abutting the raised triangular portion, the first raised side and the second raised side meeting to form an apex above the planar portion and below the raised triangular portion, the apex when proximate to the fourth vertex point diminishing to meet the fourth vertex point, with no bottom side present so as to receive the valley flashing ridge;

a second V-notch formed continuously from the second vertex point to the fourth vertex point being substantially triangular in shape with a first raised side abutting the planar portion, a second raised side abutting the raised triangular portion, the first raised side and the second raised side meeting to form an apex above the planar portion and below the raised triangular portion, the apex when proximate to the fourth vertex point diminishing to meet the fourth vertex point, with no bottom side present so as to receive the valley flashing ridge;

wherein upon positioning the bottom surface of the sheet of material upon the roof, the raised triangular portion is positioned over the adjoining roof, the first V-notch and the second V-notch is positioned over the valley flashing ridges, and the planar portion is positioned over the main roof thereby inhibiting leakage in either of the two valleys of the roof, the bottom surface of the sheet of material in complete direct contact with the main roof and the adjoining roof.

2. The cap flashing device of claim 1 wherein the sheet of material is a single sheet of material.

3. The cap flashing device of claim 1 wherein the sheet of material has a substantially rectangular shape.

4. The cap flashing device of claim 1 wherein the first vertex point is positioned at the third edge and the second vertex point is positioned at the fourth edge.

5. The cap flashing device of claim 1 and further comprising a seal along any edge of the sheet of material.

* * * * *